US012369671B2

(12) United States Patent
Bronson

(10) Patent No.: US 12,369,671 B2
(45) Date of Patent: Jul. 29, 2025

(54) AUXILIARY VISOR FOR HELMET

(71) Applicant: Kim Weeks Bronson, Beverly Hills, CA (US)

(72) Inventor: Kim Weeks Bronson, Beverly Hills, CA (US)

( * ) Notice: Subject to any disclaimer, the term of this patent is extended or adjusted under 35 U.S.C. 154(b) by 0 days.

(21) Appl. No.: 18/515,535

(22) Filed: Nov. 21, 2023

(65) Prior Publication Data

US 2024/0180284 A1 Jun. 6, 2024

Related U.S. Application Data

(63) Continuation-in-part of application No. 18/074,281, filed on Dec. 2, 2022, now abandoned.

(51) Int. Cl.
*A42B 3/22* (2006.01)
*A42B 3/32* (2006.01)
*A42B 7/00* (2006.01)

(52) U.S. Cl.
CPC ..... *A42B 3/227* (2013.01); *A42B 3/32* (2013.01); *A42B 7/00* (2013.01)

(58) Field of Classification Search
CPC ..... A42B 3/221; A42B 1/0184
See application file for complete search history.

(56) References Cited

U.S. PATENT DOCUMENTS 3,436,760 A * 4/1969 Molitoris ..... A42B 3/105 2/6.6
3,613,115 A * 10/1971 Hill ..... A61F 9/025 2/10
4,630,317 A * 12/1986 Brown ..... A61F 9/045 2/909
4,662,007 A * 5/1987 Lipkin ..... A42B 1/06 2/172
4,993,081 A * 2/1991 Fulghum ..... A42B 3/227 2/209.12
5,046,195 A * 9/1991 Koritan ..... A41D 20/00 2/916
5,099,524 A * 3/1992 Linday ..... A41D 20/00 2/171.1
5,105,476 A 4/1992 Cox
5,136,726 A 8/1992 Kellin et al.
D385,091 S * 10/1997 Rodgers ..... D2/893
(Continued)

FOREIGN PATENT DOCUMENTS

AU 2013101441 A4 1/2014

*Primary Examiner* — Khaled Annis
(74) *Attorney, Agent, or Firm* — McConnell Law Firm PC; Robert McConnell

(57) ABSTRACT

An auxiliary visor system for use with or without helmet. Includes an attachment band formed of an improved stretch loop material with loop connector material on one side and silicone on the second. The second, inward facing side secures the front visor to the helmet. The stretch material provides inwardly-directed force to the exterior surface of a helmet. The silicone material is flexible and also provides frictional grip to secure the attachment band to the exterior of the helmet. A hook material fastener couples to the loop connector material on the exterior of the improved stretch loop material to close the attachment band. An optional detachable visor attaches to the outside of the attachment strap formed of the stretch loop material with hook material.

22 Claims, 6 Drawing Sheets

(56) References Cited

U.S. PATENT DOCUMENTS 5,715,540 A * 2/1998 Cho ..... A42B 1/22 2/195.3
5,727,250 A * 3/1998 Black ..... A42B 3/227 2/10
5,862,520 A * 1/1999 Wyant ..... A42B 1/0182 2/10
5,862,523 A * 1/1999 Proctor ..... A42B 1/247 2/209.11
6,260,204 B1 * 7/2001 Morrissey ..... A42B 3/003 2/172
6,381,750 B1 * 5/2002 Mangan ..... A42B 3/225 2/10
6,493,880 B1 * 12/2002 Lo ..... A42B 1/22 2/195.2
6,546,559 B1 4/2003 Bronson
6,658,664 B1 * 12/2003 Verhoeven ..... A42B 1/22 2/12
6,694,525 B1 2/2004 Murnan
9,226,538 B2 1/2016 Kim
9,451,801 B2 * 9/2016 Bryan ..... A42B 3/044
9,498,015 B2 11/2016 Kim
9,578,918 B2 2/2017 Bryan et al.
10,188,188 B2 * 1/2019 Passarello ..... A45D 8/36
10,362,827 B2 7/2019 Bryan et al.
10,939,716 B1 * 3/2021 Toro ..... A42B 1/0184
11,147,329 B2 * 10/2021 Gholson ..... A42B 1/205
11,357,278 B2 * 6/2022 Binns ..... A42B 1/22
2002/0004946 A1 * 1/2002 Nelson ..... A42B 3/003 2/195.3
2002/0047033 A1 4/2002 Harada et al.
2002/0144334 A1 * 10/2002 Brooks ..... A42B 1/206 2/209.12
2003/0131395 A1 * 7/2003 Putnam ..... A41D 20/00 2/181
2005/0086724 A1 * 4/2005 Marsh ..... A42B 1/24 2/195.1
2005/0223475 A1 * 10/2005 Turner ..... A42B 1/22 2/209.4
2005/0251894 A1 * 11/2005 Marsh ..... A42B 1/22 2/195.3
2006/0048274 A1 * 3/2006 Lee ..... A42C 5/00 2/181
2006/0107440 A1 * 5/2006 Keffer ..... A42B 1/0188 2/175.1
2006/0277658 A1 * 12/2006 Marsh ..... A42B 1/24 2/171
2007/0044203 A1 * 3/2007 Hall ..... A42B 1/206 2/171
2007/0130669 A1 * 6/2007 Rogers ..... A42B 1/22 2/195.1
2007/0192934 A1 * 8/2007 Niedrich ..... A42B 1/0184 2/171
2008/0115258 A1 * 5/2008 Hernandez ..... A42B 1/0184 2/209.12
2010/0306905 A1 12/2010 Cornell
2011/0043755 A1 2/2011 Gibson-Horn et al.
2012/0005795 A1 * 1/2012 Tilley ..... A42B 3/227 2/10
2012/0054936 A1 3/2012 Cornell
2012/0210491 A1 * 8/2012 Bryan ..... A42B 3/227 2/181.4
2013/0125292 A1 * 5/2013 Weaver ..... A42B 1/006 2/209.13
2015/0040286 A1 * 2/2015 Schultz ..... A41D 1/00 2/88
2015/0040292 A1 * 2/2015 Koh ..... A42B 1/0184 2/195.7
2015/0047099 A1 * 2/2015 Koh ..... A42B 1/0184 2/209.3
2015/0089715 A1 * 4/2015 Chan ..... A42B 1/22 2/183
2016/0183621 A1 6/2016 Reeves
2017/0156431 A1 * 6/2017 Hester ..... A42B 1/0184
2018/0146734 A1 * 5/2018 Kelly ..... A42B 1/004
2018/0255859 A1 * 9/2018 Gerstle ..... A42C 5/02
2019/0380423 A1 * 12/2019 Fernando ..... A42C 5/04
2021/0100308 A1 * 4/2021 Smith ..... A42B 1/206
2022/0264982 A1 * 8/2022 Binns ..... A42B 1/22

* cited by examiner

AUXILIARY VISOR FOR HELMET

BACKGROUND OF THE INVENTION

Field of the Invention

The present invention relates to gear for outdoor use that protects the wearer's head, face, neck and upper body from sun exposure. The present invention is designed to be used with various types of headgear, including helmets, or worn directly on the wearer's head.

One specific application of the visor is for use in horseback riding as an improved auxiliary visor system for a rider's helmet. In addition to riding helmets, the visor may used with any number of other sporting helmets, including bike helmets, ski helmets, skating helmets, scooter helmets, baseball helmets, snowmobile helmets, mountaineering helmets and any other helmet that could utilize a visor to protect the rider from the sun and/or elements.

Participating in outdoor activities may result in considerable exposure to the sun. For this reason, protective helmets, such as those for horseback riding and other outdoor sports, commonly include a brim or bill to shade the rider's face. However the included bills/shades are generally not large enough to provide significant sun protection. As a result, the wearer is often subject to undesirable amounts of sun, which includes ultraviolet radiation. Exposure to excessive sunlight and the included UV light may result in sunburn, premature aging as well as skin cancers and melanomas. This invention relates to protection from sun for helmet wearers participating in outdoor activities. Further, the preferred embodiment of this invention relates to an improved auxiliary visor that fits over a helmet used by those riding horses.

SUMMARY OF THE INVENTION

The present invention addresses the foregoing shortcomings of the prior art by providing an auxiliary visor system adaptable to a riding helmet and/or other sporting helmets. Such a visor includes front bill and optional detachable bill for shading a wearer. The present invention may also be worn directly on a wearer's head.

An attachment band is formed of an improved stretch or elasticized material with an attachment material on one side and a second side comprised of an adhesive material with high coefficient of friction (CoF) that secures the front visor to the helmet. In the preferred embodiment, the attachment material is formed of loop material, but any attachment material well known in the art may be utilized. The adhesive material is silicone in the preferred embodiment, but any adhesive material that has a high coefficient of friction (CoF) may be used such as glue, rubber or plastic.

The stretch material provides inwardly-directed force to the exterior surface of a helmet and includes stretch characteristics in two directions. The silicone material is flexible and also provides frictional grip to secure the attachment band to the exterior of the helmet. A hook material fastener couples to the loop connector material on the exterior of the improved stretch loop material to close the attachment band.

An optional detachable visor attaches to the outside of the attachment strap formed of the stretch loop material with hook material. This detachable visor may be oriented to the rear of the helmet or in any other position desired by the wearer.

DESCRIPTION OF THE PREFERRED EMBODIMENT

The following detailed description refers to the preferred embodiment of the disclosed invention as shown in the attached figures and in the below description. This detailed description is not meant to limit the scope of the invention in any way but is intended to disclose the preferred embodiment/best mode of the invention at the time of filing this application.

The present invention is an improved visor for use with various helmets, specifically, in the preferred embodiment, a helmet for use while riding a horse. While a rider's helmet is the preferred embodiment and described below, the described visor could be used with any type of helmet such as a bike helmet, ski helmet, skating helmet, scooter helmet, baseball helmet, snowmobile helmet, mountaineering helmet and any other helmet that could utilize a visor to protect the rider from the sun.

The improved visor can be used with various protective helmets and also worn directly on the head of a wearer. It can also be coupled with any other type of headwear of the user's choice.

The preferred embodiment of this improved visor includes a stretch loop material with a silicone material on the opposite side to grip the helmet surface. This improved material provides a much more secure grip and includes stretch characteristics in two directions. While a unique stretch loop material is used in the preferred embodiment, any type of stretch or elasticized attachment material may be used included but not limited to elastic, stretch jersey, lycra, spandex, silicone, neoprene, rubber, rubber compound or any other attachment material well known in the art. In addition to silicone, any adhesive material that has a high coefficient of friction (CoF) may be used such as glue, rubber or plastic.

Additionally, this improved visor includes both a front visor and detachable visor, that may be positioned at a location of the wearer's choice, to provide better protection from the sun for the helmet wearer. The front visor and/or detachable visor may be used for any outdoor activity including without limitation walking, gardening, hiking, tennis, horseback riding, jogging, beach wear, skiing, snowboarding, walking, hiking, rock climbing, surfing, golfing, biking, spectating, polo, bird watching, tennis, miniature golf, volleyball, sun bathing, shopping, outdoor dining, farming or yard work.

The front visor and detachable visor may be formed of light weight plastic material that are opaque or semi-transparent. Both visors may also include trim sew around the outer edge of the visor brim.

Figure 1:
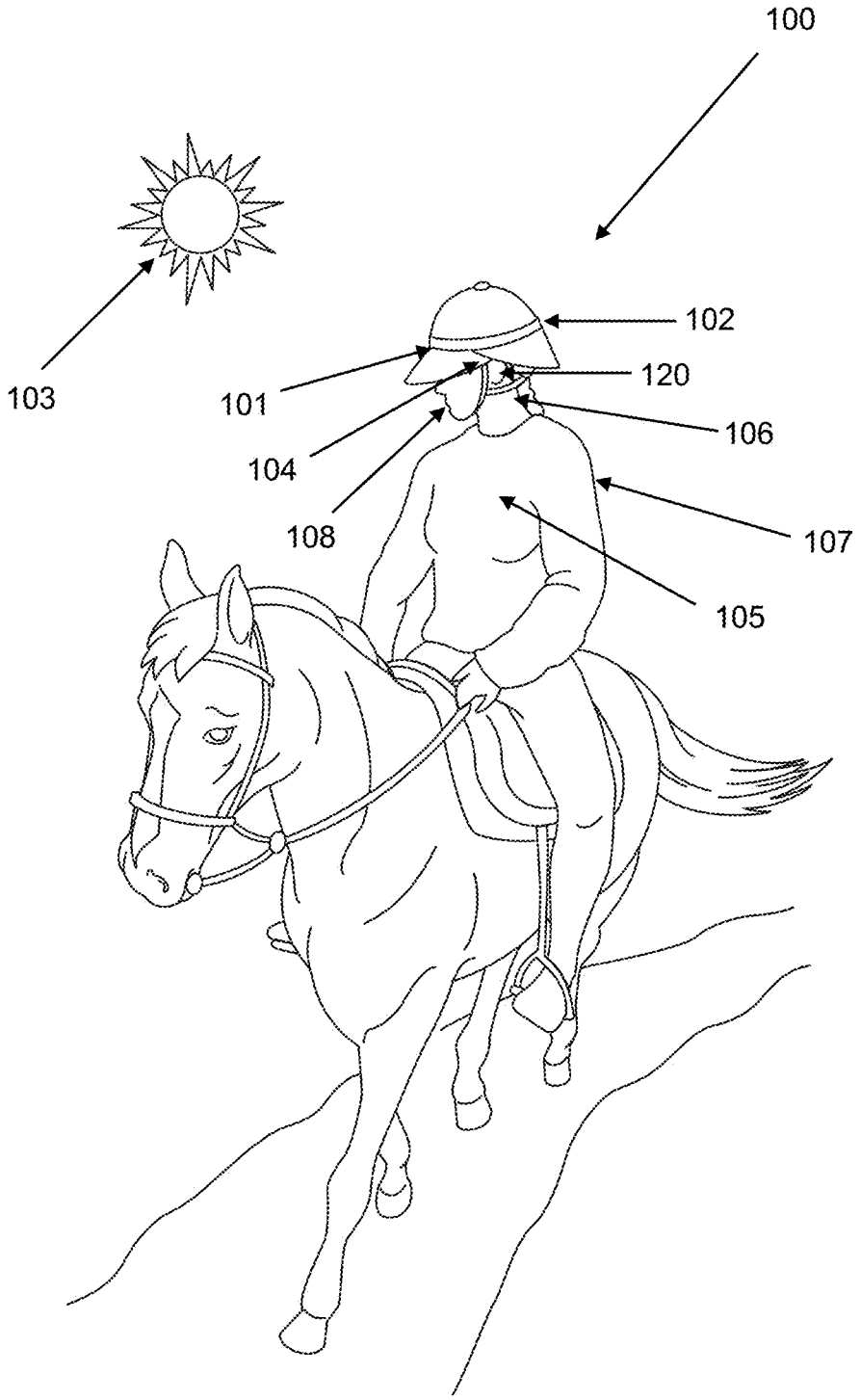
FIG. 1 is a view of a rider wearing the improved auxiliary visor system.

FIG. 1 is a view of the improved auxiliary visor system 100 show non a rider wearing a helmet. The auxiliary visor system 100 is comprised of two parts, a front visor 101 and a detachable visor 102 (positioned at the rear), each fitted over rider's helmet 104. Front visor 101 and detachable visor 102 are positioned to protect the face 108, neck 106, ears 120 and back 107 of rider 105 from sun 103. Rays from sun 103 contain UV wavelength light that can cause sunburns, other sun damage and contribute to the development of skin cancer. While some riding helmets include a small front brim that provides minimal sun protection, the auxiliary visor system 100 of the present invention provides significant shading from the sun provided by its much wider front visor 101 and detachable visor 102. Due to its increased size and shape, the auxiliary visor system 100 of the present invention blocks the rays of the sun 103 from much more of the skin of the rider.

The auxiliary visor system 100 fits over and secures to helmet 104. Because of the wide variety of shapes and exterior materials of helmet 104, auxiliary visor system 100 must be adjustable in size and flexible in its method of securing to the helmet. To this end, the improved auxiliary visor system 100 is made with an improved stretch hook and loop material with silicone on the reverse side from the loop material. This allows the rider to stretch the strap, made of the stretch hook material, of the device around any size or shape helmet and couple with hook material at the end of the strap. The silicone material provides a secure grip to the exterior of helmet 104 regardless of the surface type, i.e. matte, glossy, textured, of the helmet 104. The method of attaching the auxiliary visor system 100 to helmet 104 must secure the visor system through significant motion during riding and/or wind gusts. The improved hook and loop material will be discussed in detail in relation to a later figure.

The improved stretch loop material includes stretch characteristics in two directions: 1) a first direction laterally along the length of the strap and 2) a second direction vertically from top to bottom of the strap. The improved stretch material may stretch in a manner to increase the length of the material in the first, lateral direction from 5% to 30% of the unstretched length of the material. This stretch percentage means that the length of the stretch material may be increased from its unstretched length by to a stretched length that is 5% up to 30% greater than the unstretched length. The improved stretch material includes stretch characteristics in the second, vertical direction of 1%-10% of the unstretched length of the material. The height of the stretch material may be increased from its unstretched height by to a stretched height that is 5% up to 30% greater than the unstretched height. These stretch characteristics, for a 10 inch long by 2 inch wide piece of stretch material, translate to a total possible stretched length in the first lateral direction of 10.5 to 13 inches and a total possible stretched height in the second vertical direction of 2.02 to 2.2 inches.

While a unique stretch loop material is used in the preferred embodiment, any type of stretch or elasticized attachment material may be used included but not limited to elastic, stretch jersey, lycra, spandex, silicone, neoprene, rubber, rubber compound or any other attachment material well known in the art. In addition to silicone, any adhesive material that has a high coefficient of friction (CoF) may be used such as glue, rubber or plastic.

The auxiliary visor system 100 consists of front visor 101 and detachable visor 102. Front visor 101 forms the base of the device and is always attached to helmet 104. Detachable visor 102 is an optional, should the rider require additional protection for their neck/back, and attaches to the loop material of the strap of the front visor 101. This attachment method will be described in detail in relation to a later figure.

While FIG. 1 displays the auxiliary visor installed on a riding helmet, auxiliary visor system 100 may be worn on a helmet for any outdoor sport, including without limitation biking, snow skiing, snow boarding, ice skating, scooter riding, baseball, snowmobiling, mountaineering. Further, auxiliary visor system 100 may be worn without a helmet directly on the wearer's head or over any type of hat.

Figure 2:
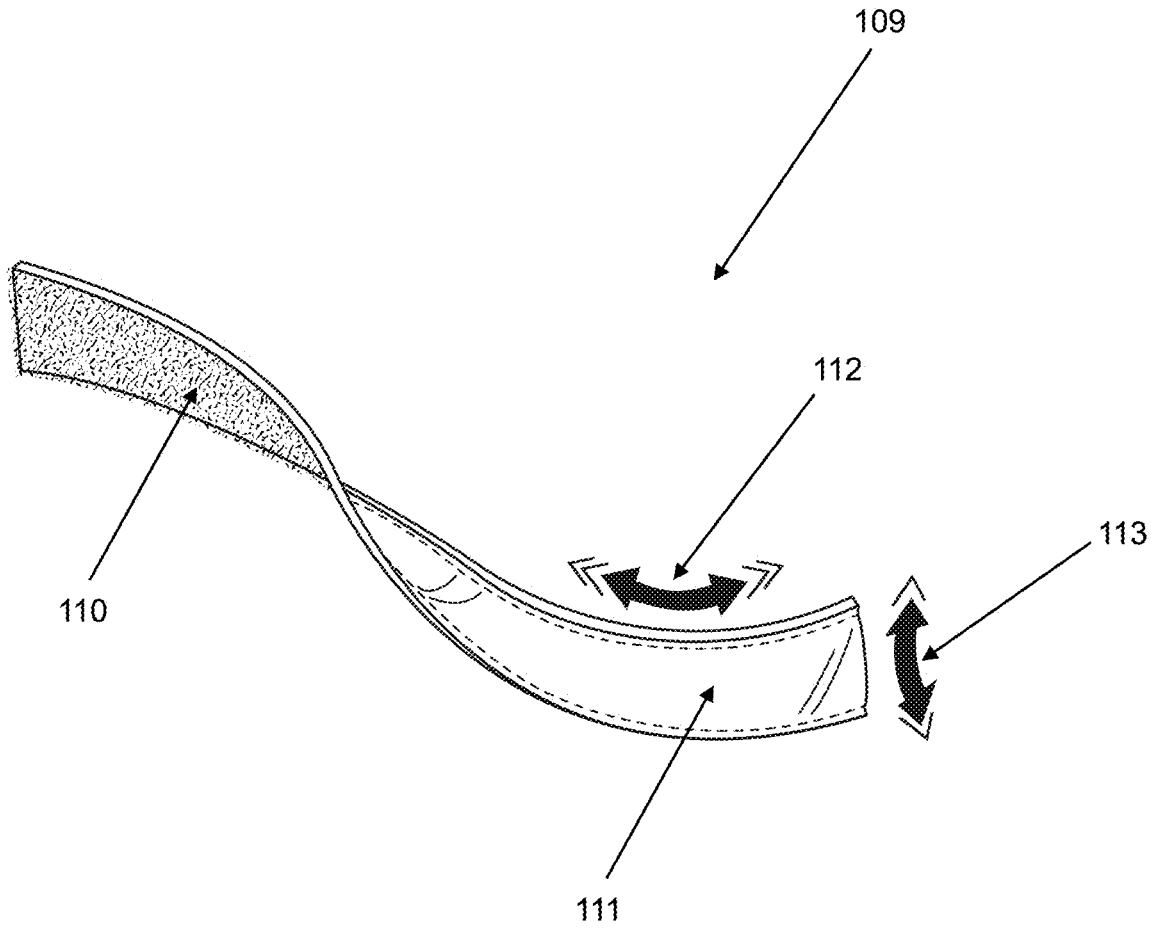
FIG. 2 is a view of the improved stretch loop material.

FIG. 2 shows the improved stretch loop material 109 used in the present invention. This material has loop material 110 on the first side and the second side is coated with silicone 111. Loop material 110 is the type that couples with hook material well known in the art. This combination is known as hook and loop or by the trademarked name "Velcro." The hook side of a hook material comprises many small extensions, often formed of plastic, that are essentially hook shaped. The loop material 110 is comprised of loops formed of thread or plastic that when placed in contact with the hooks of the hook material, the hooks catch the loops and couple the two materials together. This hook and loop coupling provides secure attachment but also the ability to detach the hook material from the loop material 110. The hook material may be attached and detached from the loop material 110 many times.

The second side of the improved stretch material (on the side opposite to the loop material) comprises a layer of silicone 111. This silicone 111 stretches in two directions around its horizontal and vertical axes. The silicone 111 also provides grip when placed in contact with smooth or textured surfaces, such as the hard shell of helmet 104. The grippy and frictional nature of silicone 111 allows the second side of improved stretch material 109 to grip the surface of a helmet.

Improved stretch loop material 109 has another significant improvement over prior art hook and loop materials as it stretches in both a first direction 112 and a second direction 113. This material stretch allows the user to stretch the material around their helmet with the horizontal force of the stretch providing additional grip to the surface of the helmet. The return force of the stretch material provides additional helmet grip when compared to prior art non-stretch hook and loop material.

In the preferred embodiment, first direction 112 is the lateral direction along the length of the stretch loop material forming the strap. Second direction 113 is the vertical direction along the height of the stretch loop material forming the strap. The improved stretch material may stretch in a manner to increase the length of the material in first direction 112 (the lateral direction) from 5% to 30% of the unstretched length of the material. This stretch percentage means that the length of the stretch material may be increased in first direction 112 from its unstretched length by to a stretched length that is 5% up to 30% greater than the unstretched length. The improved stretch material includes stretch characteristics in second direction 113 (the vertical direction) of 1%-10% of the unstretched length of the material. The height of the stretch material may be increased in second direction 113 from its unstretched height by to a stretched height that is 5% up to 30% greater than the unstretched height. These stretch characteristics, for a 10 inch long by 2 inch wide piece of stretch material, translate to a total possible stretched length in first direction 112 of 10.5 to 13 inches and a total possible stretched height in second direction 113 of 2.02 to 2.2 inches.

Figure 3:
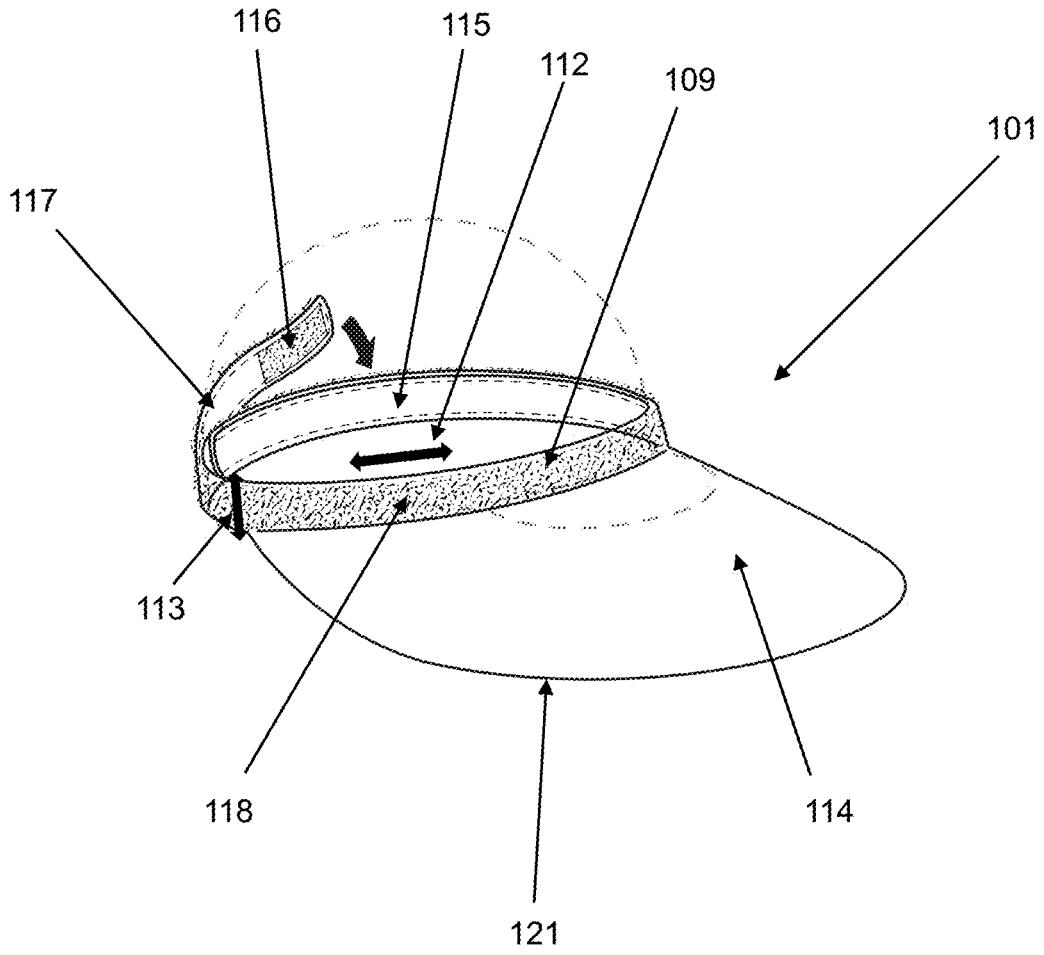
FIG. 3 is a side view of the front visor.

FIG. 3 is a side view of front visor 101 of the present invention. Front visor 101 is comprised of brim 114, attachment strap 118 formed of improved stretch loop material 4 with first end 115 and second end 117, and hook connector 116. Attachment strap wraps around the edge of the helmet with the silicone 111 of improved stretch loop 6 material 109 contacting the surface of helmet 104 (not shown). The gripping and high coefficient of friction/CoF nature of silicone 111 provide a secure fit to the surface of the 8 helmet. Attachment strap 118 is stretched around the rear of helmet 104 where hook connector 116 of second end 117 is coupled with loop material 110 of improved stretch loop material 109. The coupling of the hook connector 116 and loop material 110 provide secure attachment of first end 115 and second end 117 of attachment strap 118. Between the lateral force of the stretch material and the gripping nature of the silicone on the underside of the improved stretch material 109, front visor 101 is securely fitted to helmet 104. The stretch characteristic is shown in the first direction 112 along the lateral length of attachment strap 118 and in the second direction 113 along the vertical height of attachment strap 118.

In the preferred embodiment, brim 114 is sewn directly to the lateral edge of attachment strap 118, but can be attached by any means well known in the art. Further, the while in the preferred embodiment brim 114 is attached directly to attachment strap 118, that arrangement is not required by the claims of this patent. In the preferred embodiment, brim 114 is made of light weight recyclable plastic material with fabric trim sewn around the outer edge 121 of brim 114. In another preferred embodiment, the brim is formed of translucent plastic with an approximately 82% opacity. This translucent characteristic allows the rider to see through brim 114 but still be shaded from the sun.

Brim 114 could also be made from any material well known in the art, including any stiff or semi-stiff structural substrate (cardboard, plastic, wire frames) covered with various materials, including fabric, plastic, felt, leather, denim, twill, mesh, and/or polyester. Further, such materials may also be used without a substrate. Additionally, transparent materials with any level of opacity may be utilized such as transparent polycarbonate, translucent polycarbonate, tinted polycarbonate, colored polycarbonate, clear plastic, tinted plastic, and colored plastic. While this list of materials is extensive, it is not intended to limit the types of materials that may be utilized to manufacture brim 114 and any suitable material may be utilized for brim 114 within the claims of the present invention.

Figure 4:
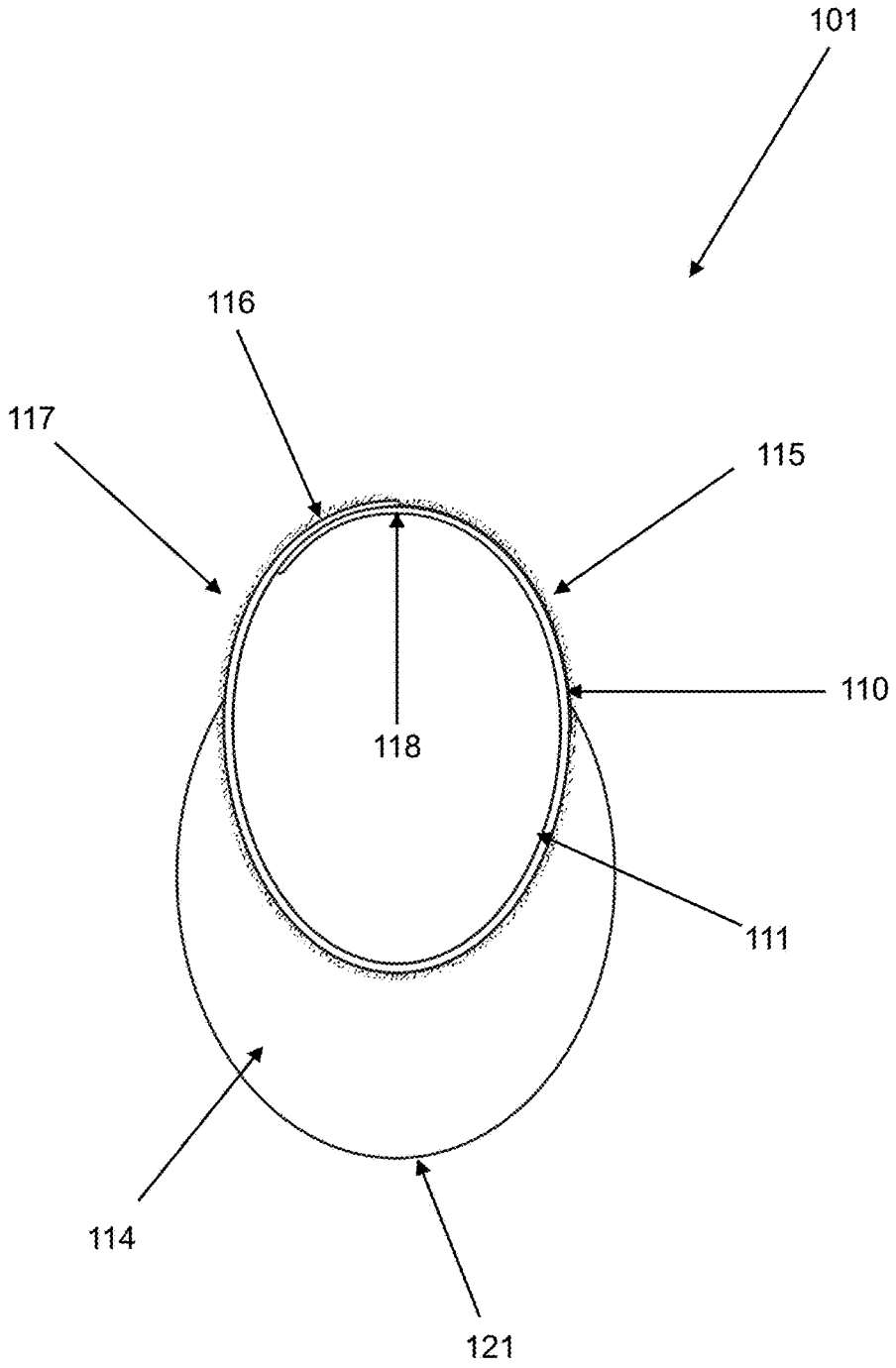
FIG. 4 is a top view of the front visor.

FIG. 4 is a top view of first visor 101. In this view, first end 115 is coupled to second end 117 of attachment strap 118. Hook connector 116 is coupled to loop material 110 to secure attachment strap 118 around the edge of helmet 104 (not shown). Silicone 111 is providing grip that additionally secures attachment strap 118 around the edge of helmet 104 (not shown).

While a unique stretch loop material is used in the preferred embodiment for attachment strap 118, any type of stretch or elasticized attachment material may be used included but not limited to elastic, stretch jersey, lycra, spandex, silicone, neoprene, rubber, rubber compound or any other attachment material well known in the art. In addition to silicone, any adhesive material that has a high coefficient of friction (CoF) may be used such as glue, rubber or plastic.

Figure 5:
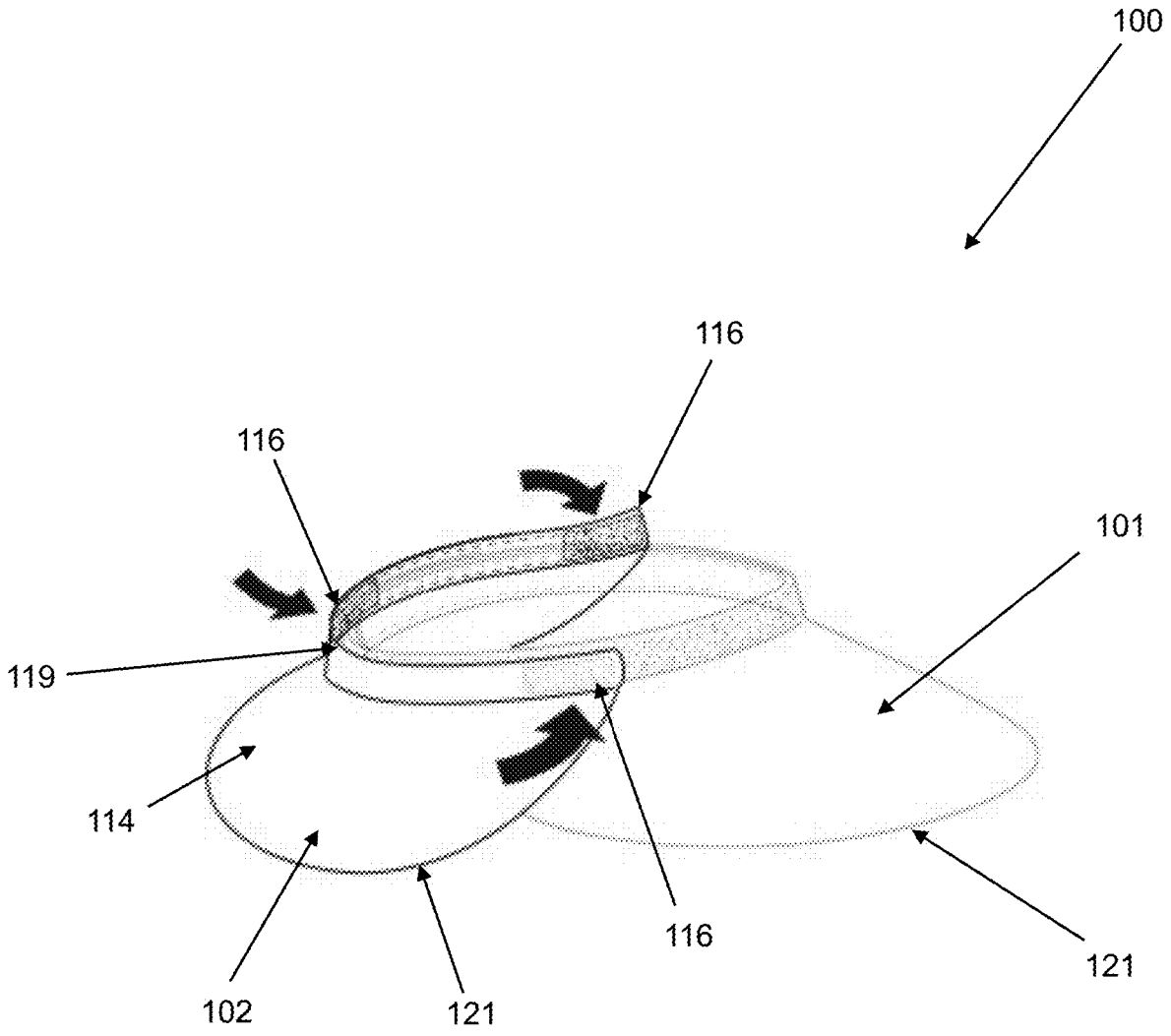
FIG. 5 is a side view of the detachable visor attached to the front visor.

FIG. 5 is a view of the auxiliary visor system 100 with the optional detachable visor 102 attached to front visor 101. In this embodiment, detachable visor 102 is comprised of brim 114 and attachment area 119. Attachment area 119 is located above brim 114 and includes one or more connectors 116 around the rear of attachment area 119 and configured to couple with loop material 110 on the exterior of attachment strap 118. Attachment strap 118 is part of front brim 101. When connectors 116 are coupled to loop material 110 on the exterior of attachment strap 118, detachable visor 102 is securely attached to front visor 101.

Connectors 116 are hook material in the preferred embodiment, but any connector suitable for connection to the various materials of attachment strap 118 may be used, including without limitation clasps, snaps and clips.

In the preferred embodiment, brim 114 is made of light weight recyclable plastic material with fabric trim sewn around the outer edge 121 of brim 114. In another preferred embodiment, the brim is formed of translucent plastic with an approximately 82% opacity. This translucent characteristic allows the rider to see through brim 114 but still be shaded from the sun. Brim 114 could also be made from any material well known in the art including any stiff or semi-stiff structural substrate (cardboard, plastic, wire frames) covered with various materials, including fabric, plastic, felt, leather, denim, twill, mesh, and/or polyester. Further, such materials may also be used without a substrate. Additionally, transparent materials with any level of opacity may be utilized such as transparent polycarbonate, translucent polycarbonate, tinted polycarbonate, colored polycarbonate, clear plastic, tinted plastic, and colored plastic. While this list of materials is extensive, it is not intended to limit the types of materials that may be utilized to manufacture brim 114 and any suitable material may be utilized for brim 114 within the claims of the present invention.

Figure 6:
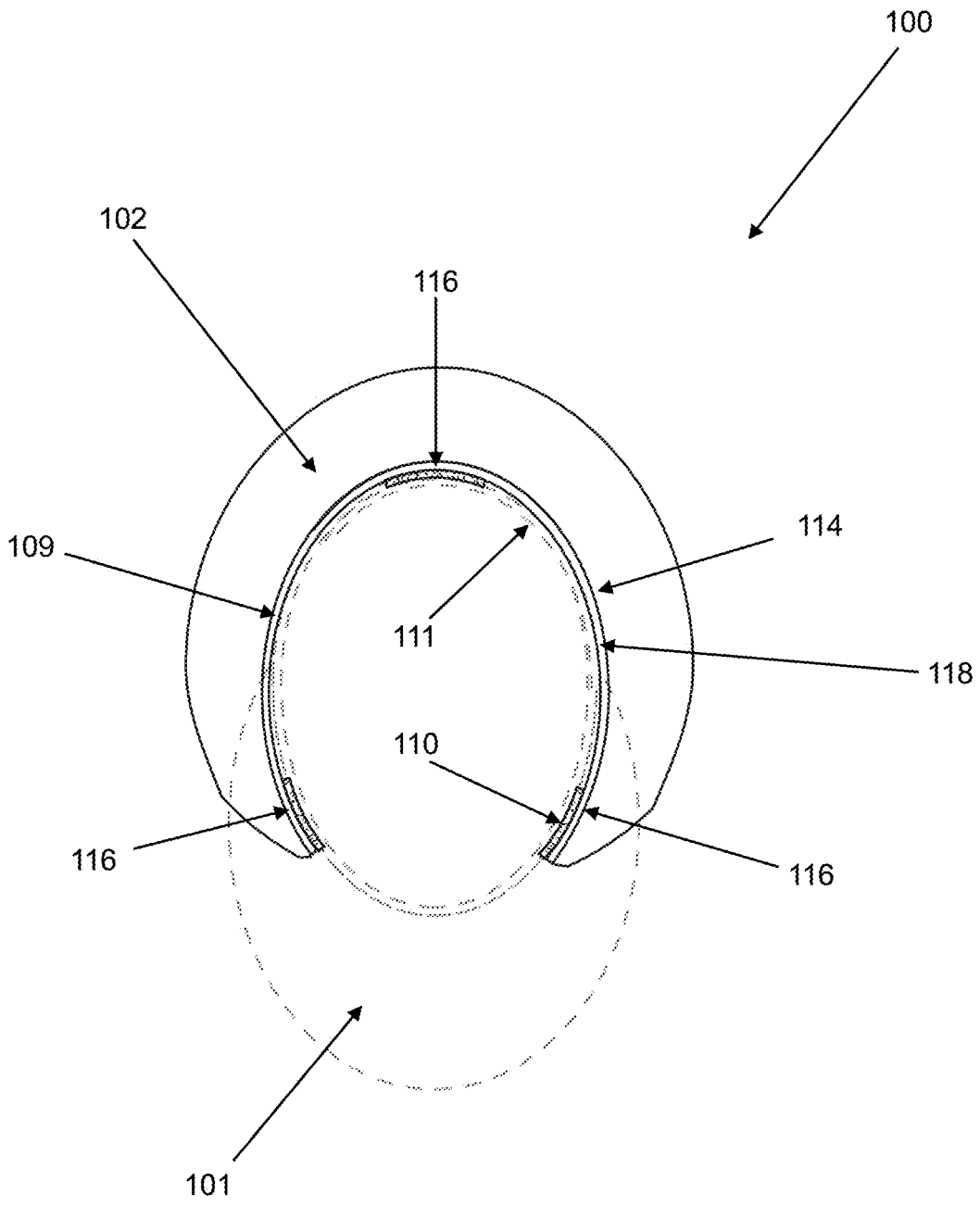
FIG. 6 is a top view of the detachable visor attached to the front visor.

FIG. 6 is a top view of the auxiliary visor system 100 with the optional detachable visor 102 attached to front visor 101. In this embodiment, three individual hook connectors 116 are coupled to loop material 110 of improved stretch loop material 109 forming the attachment strap 118 of front visor 101. Hook connectors 116 are attached to the rear of attachment area 119 of detachable visor 102. These hook connectors securely couple detachable visor 102 to front visor 101. Improved stretch loop material 109 with silicone 111 on the inside of attachment strap 118 wraps around the exterior of helmet 104 (not shown). The silicone 111 and additional pressure created by the stretch loop material 109 firmly secure the auxiliary visor system 100 to helmet 104 (not shown).

Although the present invention has been described in relation to the above disclosed preferred embodiment, many modifications in design, implementation, systems and execution are possible while still maintaining the novel features and advantages of the invention. The preferred embodiment is not meant to limit the scope of the patent in any way, and it should be given the broadest possible interpretation consistent with the language of the disclosure on the whole.

The invention claimed is:

1. An auxiliary visor for use with a helmet comprising:

A first brim for shading the wearer;

an attachment strap fixed to the first brim, the attachment strap being formed of an improved stretch material, where the improved stretch material is a single piece of material and comprising a first end, a second end, a first side and a second side, where the first side consists of a stretch loop material being stretchable in a first direction and a second direction, where the stretch material has a first direction stretch characteristic and a second direction stretch characteristic, where the first direction stretch characteristic and the second direction stretch characteristic are not equal to each other, the second side consists of an adhesive material, and where the first end further comprises a hook material that couples with the loop material of the second side to close the attachment strap around the helmet, and when the attachment strap is closed around the helmet, the stretch material providing an inwardly-directed force to the exterior of the helmet and the adhesive material provides a frictional force to secure the attachment strap to the exterior of the helmet.

2. The auxiliary visor of claim 1 further comprising:

a detachable visor with a second brim, an attachment area fixed to the second brim, where the attachment area further comprises at least one hook connector, where said hook connector couples to the loop material of the attachment strap of the auxiliary visor to secure the detachable visor to the auxiliary visor.

3. The auxiliary visor of claim 1 where the first direction is laterally along a length of the attachment strap and the first direction stretch characteristic allows the total length of the stretch material to increase in the first direction in an amount from 5% to 30%.

4. The auxiliary visor of claim 1 where the second direction is vertically along a height of the attachment strap and the second direction stretch characteristic allows the total height of the stretch material to increase in the second direction in an amount from 1% to 10%.

5. The auxiliary visor of claim 1 where the helmet is for an activity selected from the group comprising horseback riding, biking, skiing, ice skating, scooter riding, baseball, snowmobiling and mountaineering.

6. The auxiliary visor of claim 1 where the first brim is formed of a substrate covered with a material selected from the group consisting of fabric, plastic, felt, leather, denim, twill, mesh, and polyester.

7. The auxiliary visor of claim 6 where the substrate is selected from the group consisting of plastic, wire mesh and cardboard.

8. The auxiliary visor of claim 1 where the first brim is formed of a material selected from the group consisting of fabric, plastic, recyclable light weight plastic, felt, leather, denim, twill, mesh, polyester, transparent polycarbonate, translucent polycarbonate, tinted polycarbonate, colored polycarbonate, clear plastic, translucent plastic, tinted plastic, and colored plastic.

9. The auxiliary visor of claim 2 where the second brim of the detachable visor is formed of a substrate covered with a material selected from the group consisting of fabric, plastic, felt, leather, denim, twill, mesh, and polyester.

10. The auxiliary visor of claim 9 where the substrate is selected from the group consisting of plastic, wire mesh and cardboard.

11. The auxiliary visor of claim 2 where the second brim is formed of a material selected from the group consisting of fabric, plastic, light weight recyclable plastic, felt, leather, denim, twill, mesh, polyester, transparent polycarbonate, translucent polycarbonate, tinted polycarbonate, colored polycarbonate, clear plastic, tinted plastic, and colored plastic.

12. An auxiliary visor for wearing on a person's head comprising:

a first brim for protecting the person;

an attachment strap fixed to the first brim, the attachment strap being formed of an improved stretch material, where the improved stretch material is a single piece of material comprising a first end, a second end, a first side and a second side, where the first side consists of a stretch loop material being stretchable in a first direction and a second direction, where the stretch material has a first direction stretch characteristic and a second direction stretch characteristic, where the first direction stretch characteristic and the second direction stretch characteristic are not equal to each other, the second side consists of an adhesive material, and where the first end further comprises a hook material that couples with the loop material of the second side to close the attachment strap around the head of the person, and when the attachment strap is closed around the head of the person, the stretch material providing an inwardly-directed force to the exterior of the head of the person and the adhesive material provides a frictional force to secure the attachment strap to the head of the person.

13. The auxiliary visor of claim 12 further comprising:

a detachable visor with a second brim, an attachment area fixed to the second brim, where the attachment area further comprises at least one hook connector, where said hook connector couples to the loop material of the attachment strap of the auxiliary visor to secure the detachable visor to the auxiliary visor.

14. The auxiliary visor of claim 12 where the first direction is laterally along a length of the attachment strap and the first direction stretch characteristic allows the total length of the stretch material to increase in the first direction in an amount from 5% to 30%.

15. The auxiliary visor of claim 12 where the second direction is vertically along a height of the attachment strap and the second direction stretch characteristic allows the total height of the stretch material to increase in the second direction in an amount from 1% to 10%.

16. The auxiliary visor of claim 12 where the auxiliary visor is for use in outdoor activities selected from the group comprising walking, gardening, hiking, tennis, horseback riding, jogging, beach wear, skiing, snowboarding, walking, hiking, rock climbing, surfing, golfing, biking, spectating, polo, bird watching, tennis, miniature golf, volleyball, sun bathing, shopping, outdoor dining, farming or yard work.

17. The auxiliary visor of claim 12 where the first brim is formed of a substrate covered with a material selected from the group consisting of fabric, plastic, felt, leather, denim, twill, mesh, and polyester.

18. The auxiliary visor of claim 17 where the substrate is selected from the group consisting of plastic, wire mesh and cardboard.

19. The auxiliary visor of claim 12 where the first brim is formed of a material selected from the group consisting of fabric, plastic, light weight recyclable plastic, felt, leather, denim, twill, mesh, polyester, transparent polycarbonate, translucent polycarbonate, tinted polycarbonate, colored polycarbonate, clear plastic, tinted plastic, and colored plastic.

20. The auxiliary visor of claim 13 where the second brim of the detachable visor is formed of a substrate covered with a material selected from the group consisting of fabric, plastic, felt, leather, denim, twill, mesh, and polyester.

21. The auxiliary visor of claim 19 where the substrate is selected from the group consisting of plastic, wire mesh and cardboard.

22. The auxiliary visor of claim 13 where the second brim is formed of a material selected from the group consisting of fabric, plastic, light weight recyclable plastic, felt, leather, denim, twill, mesh, polyester, transparent polycarbonate, translucent polycarbonate, tinted polycarbonate, colored polycarbonate, clear plastic, tinted plastic, and colored plastic.

* * * * *